US011506424B2

(12) United States Patent
Li et al.

(10) Patent No.: US 11,506,424 B2
(45) Date of Patent: Nov. 22, 2022

(54) SINGLE-STAGE EJECTOR-BASED CRYOGENIC REFRIGERATION SYSTEM FOR COLD ENERGY RECOVERY

(71) Applicant: XI'AN JIAOTONG UNIVERSITY, Shaanxi (CN)

(72) Inventors: Cui Li, Shaanxi (CN); Yuhan Zhuang, Shaanxi (CN); Yiwei Cheng, Shaanxi (CN); Jiamin Shi, Shaanxi (CN); Yanzhong Li, Shaanxi (CN)

(73) Assignee: XI'AN JIAOTONG UNIVERSITY, Xi'an (CN)

( * ) Notice: Subject to any disclaimer, the term of this patent is extended or adjusted under 35 U.S.C. 154(b) by 70 days.

(21) Appl. No.: 17/329,271

(22) Filed: May 25, 2021

(65) Prior Publication Data

US 2021/0333022 A1 Oct. 28, 2021

Related U.S. Application Data

(62) Division of application No. 16/937,558, filed on Jul. 23, 2020, now Pat. No. 11,047,604.

(30) Foreign Application Priority Data

Jul. 24, 2019 (CN) ..... 201910669449.X

(51) Int. Cl.
*F25B 9/00* (2006.01)
*F25B 9/14* (2006.01)

(52) U.S. Cl.
CPC ..... *F25B 9/002* (2013.01); *F25B 9/14* (2013.01); *F25B 2341/0012* (2013.01)

(58) Field of Classification Search
CPC .... F25B 9/002; F25B 9/14; F25B 2341/0012; F25B 9/08; F25B 40/00; F25B 41/00; F25B 9/00; F25B 40/06; F25D 19/006; F25D 31/00
See application file for complete search history.

(56) References Cited

U.S. PATENT DOCUMENTS 6,442,949 B1 * 9/2002 Laskaris ..... F25B 25/005 62/505
6,679,066 B1 * 1/2004 Funayama ..... F25B 25/005 62/500

* cited by examiner

*Primary Examiner* — Ana M Vazquez

(57) ABSTRACT

An ejector-based cryogenic refrigeration system for cold energy recovery includes a first cryogenic refrigeration loop connected by a helium compressor and a cryogenic refrigerator and a second cryogenic refrigeration loop connected by the helium compressor, a regenerator, an ejector, a cold head of the cryogenic refrigerator, an end to be cooled and a pressure regulating valve. The cryogenic refrigerator is separated from the end to be cooled. The cryogenic refrigerator and the cryogenic helium cooling loop share a helium compressor, which improves the utilization efficiency of the device and reduces the cost. The ejector allows a part of fluids to circulate in the cryogenic loop, so as to maintain a required cryogenic condition, recover the pressure of the fluids, reduce the gas flowing though the compressor loop, and thus reduce the power consumption of the compressor.

1 Claim, 3 Drawing Sheets

SINGLE-STAGE EJECTOR-BASED CRYOGENIC REFRIGERATION SYSTEM FOR COLD ENERGY RECOVERY

CROSS-REFERENCE TO RELATED APPLICATION

This application is a divisional of U.S. application Ser. No. 16/937,558, filed on Jul. 23, 2020, which claims the benefit of priority from Chinese Patent Application No. 201910669449.X, filed on Jul. 24, 2019. The content of the aforementioned application, including any intervening amendments thereto, is incorporated herein by reference in its entirety.

TECHNICAL FIELD

This application relates to a cryogenic refrigeration system, and more particularly to an ejector-based cryogenic refrigeration system for cold energy recovery.

BACKGROUND OF THE DISCLOSURE

Superconductivity means that resistance of certain metals, alloys or compounds decreases to almost zero when they are at a specific temperature close to absolute zero. Due to the zero resistance and perfect diamagnetism, superconducting materials are widely used in electronic applications such as superconducting microwave devices, superconducting computers and superconducting antennas, etc.; large current applications such as superconducting power generation, superconducting power transmission and superconducting magnetic energy storage (SMES), etc.; and diamagnetism applications such as thermonuclear fusion reactors.

Extremely low temperature conditions are required to cool materials so as to achieve the superconductivity of the materials, thus enabling the material to work at zero resistance. Generally, the material is cooled by immersing the material in liquid helium. However, some moving devices, such as generators with rotors, cannot be cooled by being immersed in the liquid helium. Therefore, low-temperature circulation pipes with cold head can be set outside of such moving devices for cooling.

The low-temperature helium is circulated in the circulation pipes to cool the devices. The circulating pumps are generally at the normal atmospheric temperature, and counter flow heat exchangers (regenerators) are adopted to recover the cold energy of the low-temperature helium, and the excess cold is used to cool the helium at the normal temperature. However, in the circulating process, there is much helium gas flowing through the compressor, resulting in that the compressor consumes a large power, which causes a low efficiency of the system. In addition, there is a large flow resistance when fluids flow through the heat regenerator. Besides, if the low temperature is directly provided by the cold head of the cryogenic refrigerator, the vibration of the refrigerator may influence the end to be cooled.

SUMMARY OF THE DISCLOSURE

In view of the defects in the prior art, the present disclosure aims to provide an ejector-based cryogenic refrigeration system for cold energy recovery, in which a part of fluids circulates in the low-temperature loop to maintain a low-temperature condition. Therefore, the gas flowing through the compressor loop is reduced, so that the power consumption of the compressor and the flow resistance loss are reduced, and thus the efficiency of the system is improved.

To achieve the above objects, the present disclosure provides an ejector-based cryogenic refrigeration system for cold energy recovery, comprising a first cryogenic refrigeration loop connected by a helium compressor and a cryogenic refrigerator and a second cryogenic refrigeration loop connected by the helium compressor, a regenerator, an ejector, a cold head of cryogenic refrigerator, an end to be cooled and a pressure regulating valve. The cryogenic refrigerator is separated from the end to be cooled. When there is one regenerator, the ejector is arranged between the regenerator and the cold head of the cryogenic refrigerator, or between the helium compressor and the regenerator. When there are two regenerators, the ejector is arranged between the regenerator and the cold head of the cryogenic refrigerator, or between the two regenerators.

An ejector-based cryogenic refrigeration system for cold energy recovery, comprising a helium compressor; wherein a first outlet of the helium compressor is connected to an inlet of a cryogenic refrigerator; an outlet of the cryogenic refrigerator is communicated with the inlet of the cryogenic refrigerator and is connected to an inlet of the helium compressor, so that a cold head of the cryogenic refrigerator has a temperature of 20 K;

a second outlet of the helium compressor is connected to a hot fluid inlet of a regenerator; a hot fluid outlet of the regenerator is connected to a primary inlet of an ejector; an outlet of the ejector has two ports; a first port of the outlet of the ejector is connected to an inlet of the cold head of the cryogenic refrigerator; an outlet of the cold head of the cryogenic refrigerator is connected to an inlet of an end to be cooled; an outlet of the end to be cooled is connected to a secondary inlet of the ejector; a second port of the outlet of the ejector is connected to a cold fluid inlet of the regenerator; a cold fluid outlet of the regenerator is connected to an inlet of a pressure regulating valve; and an outlet of the pressure regulating valve is connected to the inlet of the helium compressor.

An ejector-based cryogenic refrigeration system for cold energy recovery, comprising a helium compressor; wherein a first outlet of the helium compressor is connected to an inlet of a cryogenic refrigerator; an outlet of the cryogenic refrigerator is communicated with the inlet of the cryogenic refrigerator and is connected to an inlet of the helium compressor, so that a cold head of the cryogenic refrigerator has a temperature of 20 K;

a second outlet of the helium compressor is connected to a hot fluid inlet of a regenerator; a hot fluid outlet of the regenerator is connected to a primary inlet of an ejector; an outlet of the ejector is connected to an inlet of the cold head of the cryogenic refrigerator; an outlet of the cold head of the cryogenic refrigerator is connected to an inlet of an end to be cooled; a first outlet of the end to be cooled is connected to a secondary inlet of the ejector, and a second outlet of the end to be cooled is connected to a cold fluid inlet of the regenerator; a cold fluid outlet of the regenerator is connected to an inlet of a pressure regulating valve; and an outlet of the pressure regulating valve is connected to the inlet of the helium compressor.

An ejector-based cryogenic refrigeration system for cold energy recovery, comprising a helium compressor; wherein a first outlet of the helium compressor is connected to an inlet of a cryogenic refrigerator; an outlet of the cryogenic refrigerator is communicated with the inlet of the cryogenic refrigerator and is connected to an inlet of the helium compressor, so that a cold head of the cryogenic refrigerator has a temperature of 20 K;

a second outlet of the helium compressor is connected to a primary inlet of an ejector; an outlet of the ejector has two ports; a first port of the outlet of the ejector is connected to a hot fluid inlet of a regenerator; a hot fluid outlet of the regenerator is connected to an inlet of the cold head of the cryogenic refrigerator; an outlet of the cold head of the cryogenic refrigerator is connected to an inlet of an end to be cooled; an outlet of the end to be cooled is connected to a cold fluid inlet of the regenerator; a cold fluid outlet of the regenerator is connected to a secondary inlet of the ejector; a second port of the outlet of the ejector is connected to an inlet of a pressure regulating valve; and an outlet of the pressure regulating valve is connected to the inlet of the helium compressor.

An ejector-based cryogenic refrigeration system for cold energy recovery, comprising a helium compressor; wherein a first outlet of the helium compressor is connected to an inlet of a cryogenic refrigerator; an outlet of the cryogenic refrigerator is communicated with the inlet of the cryogenic refrigerator is connected to an inlet of the helium compressor, so that a cold head of the cryogenic refrigerator has a temperature of 20 K;

a second outlet of the helium compressor is connected to a hot fluid inlet of a first regenerator; a hot fluid outlet of the first regenerator has two ports; a first port of the hot fluid outlet of the first regenerator is connected to a hot fluid inlet of a second regenerator; a hot fluid outlet of the second regenerator is connected to an inlet of the cold head of the cryogenic refrigerator; an outlet of the cold head of the cryogenic refrigerator is connected to an inlet of an end to be cooled; an outlet of the end to be cooled is connected to a secondary inlet of an ejector; a second port of the hot fluid outlet of the first regenerator is connected to a primary inlet of the ejector; an outlet of the ejector is connected to a cold fluid inlet of the second regenerator; a cold fluid outlet of the second regenerator is connected to a cold fluid inlet of the first regenerator; a cold fluid outlet of the first regenerator is connected to an inlet of a pressure regulating valve; and an outlet of the pressure regulating valve is connected to the inlet of the helium compressor.

An ejector-based cryogenic refrigeration system for cold energy recovery, comprising a helium compressor; wherein a first outlet of the helium compressor is connected to an inlet of a cryogenic refrigerator; an outlet of the cryogenic refrigerator is communicated with the inlet of the cryogenic refrigerator and is connected to an inlet of the helium compressor, so that a cold head of the cryogenic refrigerator has a temperature of 20 K;

a second outlet of the helium compressor is connected to a hot fluid inlet of a first regenerator; a hot fluid outlet of the first regenerator is connected to a hot fluid inlet of a second regenerator; a hot fluid outlet of the second regenerator is connected to an inlet of the cold head of the cryogenic refrigerator; a third outlet of the helium compressor is connected to a primary inlet of an ejector; an outlet of the ejector has two ports; a first port of the outlet of the ejector is connected to the inlet of the cold head of the cryogenic refrigerator; an outlet of the cold head of the cryogenic refrigerator is connected to an inlet of an end to be cooled; an outlet of the end to be cooled is connected to a cold fluid inlet of the second regenerator; a cold fluid outlet of the second regenerator is connected to a secondary inlet of the ejector; a second port of the outlet of the ejector is connected to a cold fluid inlet of a first regenerator; a cold fluid outlet of the first regenerator is connected to an inlet of a pressure regulating valve; and an outlet of the pressure regulating valve is connected to the inlet of the helium compressor.

The present invention has the following beneficial effects.

The cryogenic refrigerator and the cryogenic helium cooling loop share a helium compressor, which improves the utilization efficiency of the device and reduces the cost. The ejector allows a part of fluids to circulate in the cryogenic loop, so as to maintain a required cryogenic condition, recover the pressure of the fluids, reduce the gas flowing though the compressor loop, and reduce the power consumption of the compressor. In addition, the loss caused by heat exchange and flow resistance is reduced due to the use of the ejector, so that the heat exchange efficiency is improved. Besides, the cryogenic refrigerator and the end to be cooled are separated to effectively reduce the influence of the vibration of the refrigerator on the end to be cooled, so as to ensure the balance of the end to be cooled.

DETAILED DESCRIPTION OF EMBODIMENTS

Figure 1:
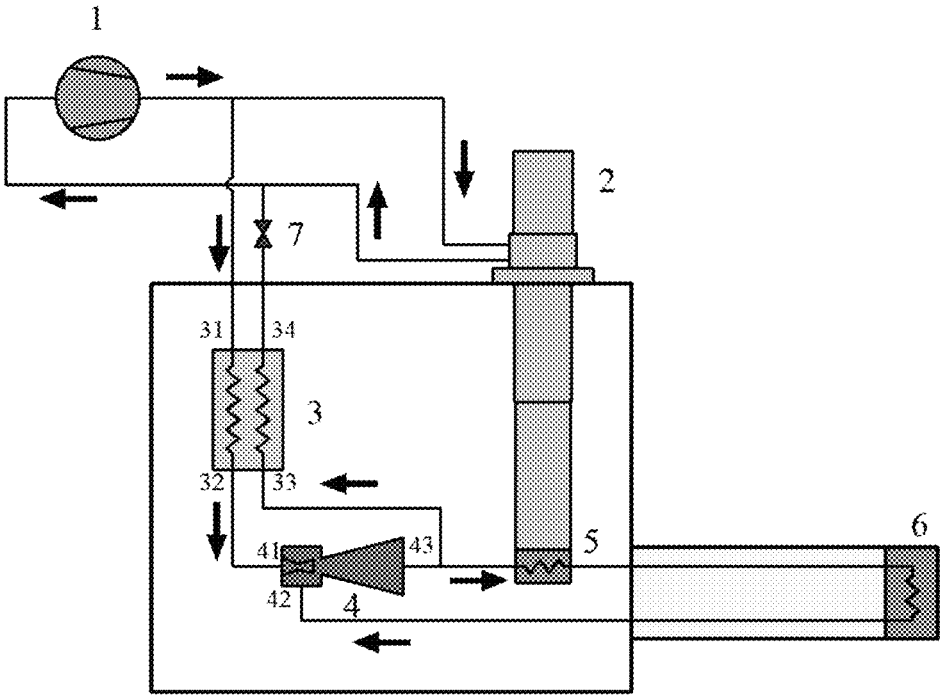
FIG. 1 is a schematic diagram of an ejector-based cryogenic refrigeration system for cold energy recovery according to at least one embodiment of the present disclosure.

The present disclosure will be described in detail below with reference to the accompanying drawings and embodiments.

The present disclosure provides an ejector-based cryogenic refrigeration system for cold energy recovery, including a first helium refrigeration loop connected by a helium compressor 1 and a cryogenic refrigerator 2 and a second helium refrigeration loop connected by the helium compressor 1, a regenerator 3, an ejector 4, a cold head 5 of the cryogenic refrigerator, an end 6 to be cooled and a pressure regulating valve 7. The cryogenic refrigerator 2 is separated from the end 6 to be cooled. When there is one regenerator 3, the ejector 4 is arranged between the regenerator 3 and the cold head 5 of the cryogenic refrigerator, or between the cryogenic refrigerator 2 and the regenerator 3. When there are two regenerators 3, the ejector 4 is arranged between the regenerator and the cryogenic refrigerator, or between the two regenerators 3.

Embodiment 1

As shown in FIG. 1, this embodiment illustrates an ejector-based cryogenic refrigerator for cold energy recovery, including a helium compressor 1. A first outlet of the helium compressor 1 is connected to an inlet of a cryogenic refrigerator 2; an outlet of the cryogenic refrigerator 2 is communicated with the inlet of the cryogenic refrigerator 2 and is connected to an inlet of the helium compressor 1, so that a cold head 5 of the cryogenic refrigerator 2 has a temperature of 20 K.

A second outlet of the helium compressor 1 is connected to a hot fluid inlet 31 of a regenerator 3. A hot fluid outlet 32 of the regenerator 3 is connected to a primary inlet 41 of an ejector 4. An outlet 43 of the ejector 4 has two ports. A first port of the outlet 43 of the ejector 4 is connected to an inlet of a cold head 5 of the cryogenic refrigerator 2. An outlet of the cold head 5 of the cryogenic refrigerator 2 is connected to an inlet of an end 6 to be cooled. An outlet of the end 6 to be cooled is connected to a secondary inlet 42 of the ejector 4. A second port of the outlet 43 of the ejector 4 is connected to a cold fluid inlet 33 of the regenerator 3. A cold fluid outlet 34 of the regenerator 3 is connected to an inlet of a pressure regulating valve 7. An outlet of the pressure regulating valve 7 is connected to the inlet of the helium compressor 1.

The working principles of the ejector-based cryogenic refrigeration system of this embodiment are described as follows. The helium is compressed in the helium compressor 1, and there are two helium cooling loops. In one loop, the high-pressure helium enters the cryogenic refrigerator 2, so that the cold head 5 of the cryogenic refrigerator has a temperature of 20 K. The low-pressure helium flows back to the helium compressor 1. In the other loop, the high-pressure helium, which is precooked when passing through the regenerator 3, enters the ejector 4 as a primary flow. The high-pressure primary flow expands and accelerates in the nozzle of the ejector 4, and entrains the low-pressure secondary flow in the suction chamber of the ejector 4. The primary flow and the secondary flow enter a mixing section, and the momentum and energy thereof are exchanged to obtain a uniformly mixed flow. The uniformly mixed flow is compressed in the diffuser of the ejector 4, and then is divided into two branches. One branch passes the cold head 5 of the cryogenic refrigerator and absorbs heat at the end 6 to be cooled, and finally enters the ejector 4 as the secondary flow, and the other branch passes through the regenerator 3 and is heated by hot flows, and finally flows back to the helium compressor 1. When the end 6 to be cooled requires a helium gas flow of 1.5 g/s, a temperature of 20 K and a cooling capacity of 75 W, the helium compressor 1 has a flow rate of 0.375 g/s, a power consumption of 1213.05 W, and the system has an efficiency of 0.0618. Compared to the conventional system, the power consumption of the ejector-based cryogenic refrigeration system is reduced by 73.5%.

Embodiment 2

Figure 2:
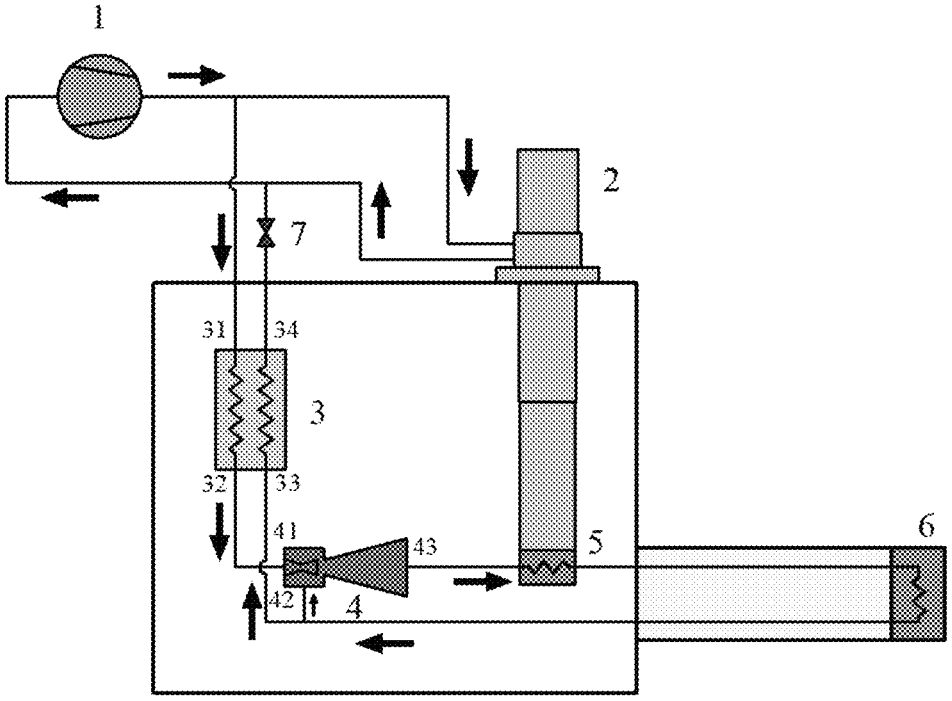
FIG. 2 is a schematic diagram of the ejector-based cryogenic refrigeration system for cold energy recovery according to at least one embodiment of the present disclosure.

As shown in FIG. 2, this embodiment illustrates an ejector-based cryogenic refrigeration system for cold energy recovery, including a helium compressor 1. A first outlet of the helium compressor 1 is connected to an inlet of a cryogenic refrigerator 2. An outlet of the cryogenic refrigerator 2 is communicated with the inlet of the cryogenic refrigerator 2 and is connected to an inlet of the helium compressor 1, so that a cold head of the cryogenic refrigerator 2 has a temperature of 20 K.

A second outlet of the helium compressor 1 is connected to a hot fluid inlet 31 of the regenerator 3. A hot fluid outlet 32 of the regenerator 3 is connected to a primary inlet 41 of the ejector 4. An outlet 43 of the ejector 4 is connected to an inlet of the cold head 5 of the cryogenic refrigerator 2. An outlet of the cold head 5 of the cryogenic refrigerator 2 is connected to an inlet of an end 6 to be cooled. A first outlet of the end 6 to be cooled is connected to a secondary inlet 42 of the ejector 4, and a second outlet of the end 6 to be cooled is connected to a cold fluid inlet 33 of the regenerator 3. A cold fluid outlet 34 of the regenerator 3 is connected to an inlet of a pressure regulating valve 7. An outlet of the pressure regulating valve 7 is connected to the inlet of the helium compressor 1.

The working principles of the ejector-based cryogenic refrigeration system of this embodiment are described as follows. The helium is compressed in the helium compressor 1, and there are two helium cooling loops. In one loop, the high-pressure helium enters the cryogenic refrigerator 2, so that the cold head 5 of the cryogenic refrigerator has a temperature of 20 K. The low-pressure helium flows back to the helium compressor 1. In the other loop, the high-pressure helium, which is precooled when passing through the regenerator 3, enters the ejector 4 as a primary flow. The high-pressure primary flow expands and accelerates in the nozzle of the ejector 4, and entrains the low-pressure secondary flow in the suction chamber of the ejector 4. The primary flow and the secondary flow enter a mixing section, and the momentum and energy thereof are exchanged to obtain a uniformly mixed flow. The uniformly mixed flow is compressed in the diffuser of the ejector 4, and then the uniformly mixed flow passes through the cold head 5 of the cryogenic refrigerator 2 and absorbs the heat at the end 6 to be cooled, and then is divided into two branches. One branch enters the ejector 4 as the secondary flow, and the other branch passes through the regenerator 3 and is heated by hot flows, and finally flows back to the helium compressor 1. When the end 6 to be cooled requires a helium gas flow of 1.5 g/s, a temperature of 20 K and a cooling capacity of 75 W, the helium compressor 1 has a flow rate of 0.37 g/s, a power consumption of 1205.28 W, and the system has an efficiency of 0.0622. Compared to the conventional system, the power consumption of the ejector-based cryogenic refrigeration system is reduced by 73.7%.

Embodiments 3

Figure 3:
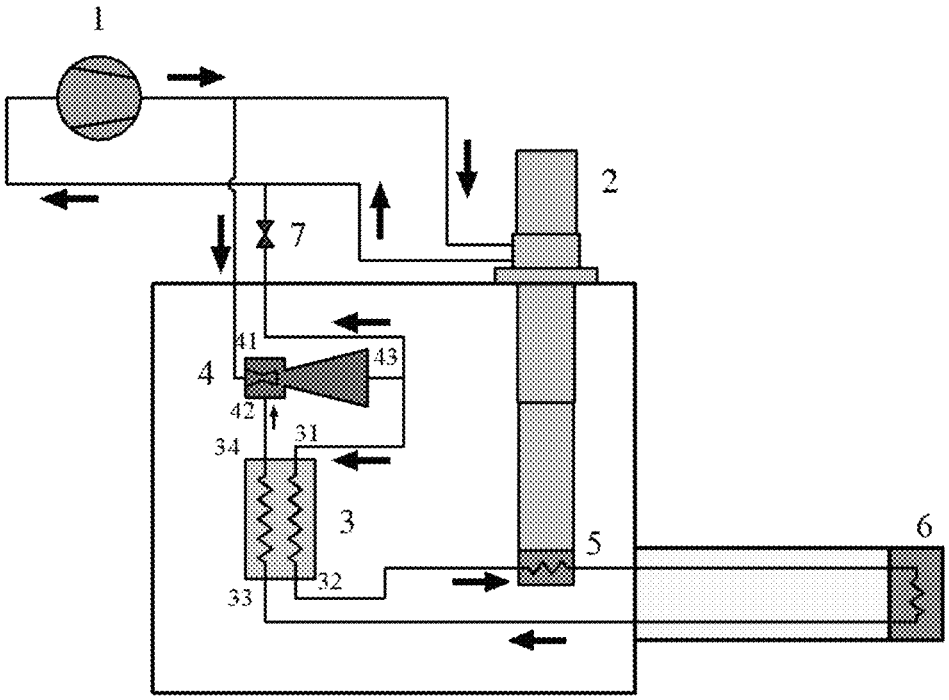
FIG. 3 is a schematic diagram of the ejector-based cryogenic refrigeration system for cold energy recovery according to at least one embodiment of the present disclosure.

As shown in FIG. 3, illustrated is an ejector-based cryogenic refrigeration system for cold energy recovery, including a helium compressor 1. A first outlet of the helium compressor 1 is connected to an inlet of a cryogenic refrigerator 2; an outlet of the cryogenic refrigerator 2 is communicated with the inlet of the cryogenic refrigerator 2 and is connected to an inlet of the helium compressor 1, so that a cold head of the cryogenic refrigerator 2 has a temperature of 20 K.

A second outlet of the helium compressor 1 is connected to a primary inlet 41 of the ejector 4. An outlet 43 of the ejector 4 has two ports. A first port of an outlet 43 of the ejector 4 is connected to a hot fluid inlet 31 of a regenerator 3. A hot fluid outlet 32 of the regenerator 3 is connected to an inlet of the cold head 5 of the cryogenic refrigerator 2. An outlet of the cold head 5 of the cryogenic refrigerator is connected to an inlet of the end 6 to be cooled. An outlet of the end 6 to be cooled is connected to a cold fluid inlet 33 of the regenerator 3. A cold fluid outlet 34 of the regenerator 3 is connected to a secondary inlet 42 of the ejector 4. A second port of the outlet 43 of the ejector 4 is connected to an inlet of a pressure regulating valve 7. An outlet of the pressure regulating valve 7 is connected to the inlet of the helium compressor 1.

The working principles of the ejector-based cryogenic refrigeration system of this embodiment are described as follows. The helium is compressed in the helium compressor 1, and there are two helium cooling loops. In one loop, the high-pressure helium enters the cryogenic refrigerator 2, so that the cold head 5 of the cryogenic refrigerator has a temperature of 20 K. The low-pressure helium flows back to the helium compressor 1. In the other loop, the high-pressure helium enters the ejector 4 as a primary flow. The high-pressure primary flow expands and accelerates in the nozzle of the ejector 4, and entrains the low-pressure secondary flow in the suction chamber of the ejector 4. The primary flow and the secondary flow enter a mixing section, and the momentum and energy thereof are exchanged to obtain a uniformly mixed flow. The uniformly mixed flow is compressed in the diffuser of the ejector 4. A first branch of the uniformly mixed flow is precooled when passing through the regenerator 3, and then passes through the cold head 5 of the cryogenic refrigerator 2 to the end 6 to be cooled to absorb heat, and then is heated when passing through the regenerator 3, and finally flows into the ejector 4 as the secondary flow. A second branch of the uniformly mixed flow flows back to the helium compressor 1. When the end 6 to be cooled requires a helium gas flow of 1.5 g/s, a temperature of 20 K and a cooling capacity of 75 W, the helium compressor 1 has a flow rate of 0.374 g/s, a power consumption of 1031.67 W, and the system has an efficiency of 0.0727. Compared to the conventional system, the power consumption of the ejector-based cryogenic refrigeration system is reduced by 77.5%.

Embodiment 4

Figure 4:
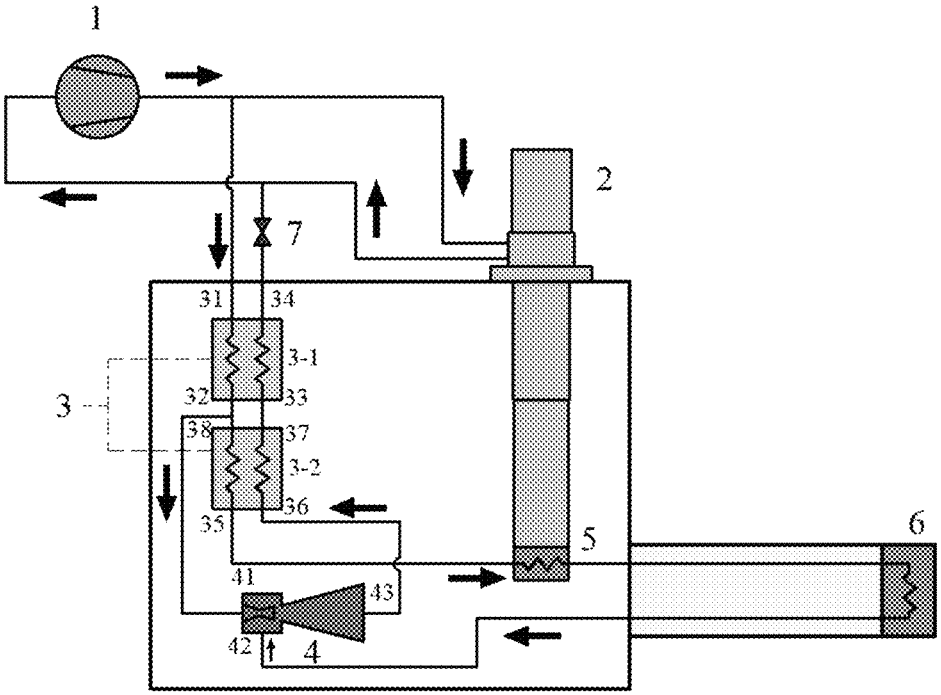
FIG. 4 is a schematic diagram of the ejector-based cryogenic refrigeration system for cold energy recovery according to at least one embodiment of the present disclosure.

As shown in FIG. 4, illustrated is an ejector-based cryogenic refrigeration system for cold energy recovery, including a helium compressor 1. A first outlet of the helium compressor 1 is connected to an inlet of a cryogenic refrigerator 2; an outlet of the cryogenic refrigerator 2 is communicated with the inlet of the cryogenic refrigerator 2 and is connected to an inlet of the helium compressor 1, so that a cold head of the cryogenic refrigerator 2 has a temperature of 20 K.

A second outlet of the helium compressor 1 is connected to a hot fluid inlet 31 of a first regenerator 3-1; A hot fluid outlet 32 of the first regenerator 3-1 has two ports. A first port of the hot fluid outlet 32 of the first regenerator 3-1 is connected to a hot fluid inlet 38 of a second regenerator 3-2. A hot fluid outlet 35 of the second regenerator 3-2 is connected to an inlet of the cold head 5 of the cryogenic refrigerator 2; an outlet of the cold end 5 of the cryogenic refrigerator 2 is connected to an inlet of an end 6 to be cooled. An outlet of the end 6 to be cooled is connected to a secondary inlet 42 of the ejector 4. A second port of the hot fluid outlet 32 of the first regenerator 3-1 is connected to a primary inlet 41 of the ejector 4; an outlet 43 of the ejector 4 is connected to an a cold fluid inlet 36 of the second regenerator 3-2; a cold fluid outlet 37 of the second regenerator 3-2 is connected to a cold fluid inlet 33 of the first regenerator 3-1; a cold fluid outlet 34 of the first regenerator 3-1 is connected to an inlet of a pressure regulating valve 7; and an outlet of the pressure regulating valve 7 is connected to the inlet of the helium compressor 1.

The working principles of the ejector-based cryogenic refrigeration system of this embodiment are described as follows. The helium is compressed in the helium compressor 1, and there are two helium cooling loops. In one loop, the high-pressure helium enters the cryogenic refrigerator 2, so that the cold head 5 of the cryogenic refrigerator has a temperature of 20 K. The low-pressure helium flows back to the helium compressor 1. In the other loop, the high-pressure helium is precooled for the first time when passing through the first regenerator 3-1. Then a part of the high-pressure helium enters the second regenerator 3-2 and is precooled for the second time, and then passes the cold end of the cryogenic refrigerator 2 to absorb heat at the end 6 to be cooled, and finally enters the ejector 4 as the secondary flow, and the other part of the high-pressure helium from the first regenerator 3-1 enters the ejector 4 as the primary flow. The high-pressure primary flow expands and accelerates in the nozzle of the ejector 4, and entrains the low-pressure secondary flow in the suction chamber of the ejector 4. The primary flow and the secondary flow enter a mixing section, and the momentum and energy thereof are exchanged to obtain a uniformly mixed flow. The uniformly mixed flow is compressed in the diffuser of the ejector 4, and then successively passes the second regenerator 3-2 and the first regenerator 3-1 and is heated by the hot flow, and finally flows back to the helium compressor 1. When the end 6 to be cooled requires a helium flow of 1.5 g/s, a temperature of 20 K and a cooling capacity of 75 W, the helium compressor 1 has a flow rate of 0.2 g/s, a power consumption of 690.83 W, and the system has an efficiency of 0.108. Compared to the conventional system, the power consumption of the ejector-based cryogenic refrigeration system is reduced by 84.9%.

Embodiment 5

Figure 5:
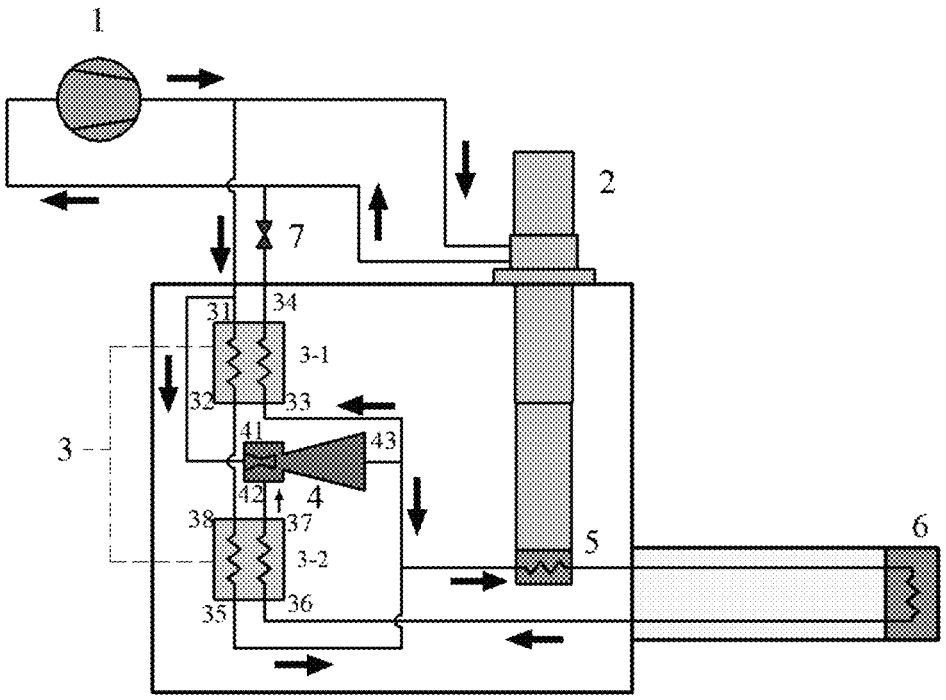
FIG. 5 is a schematic diagram of the ejector-based cryogenic refrigeration system for cold energy recovery according to at least one embodiment of the present disclosure.

As shown in FIG. 5, illustrated is an ejector-based cryogenic refrigeration system for cold energy recovery, including a helium compressor 1. A first outlet of the helium compressor 1 is connected to an inlet of a cryogenic refrigerator 2; an outlet of the cryogenic refrigerator 2 is communicated with the inlet of the cryogenic refrigerator 2 and is connected to an inlet of the helium compressor 1, so that a cold head of the cryogenic refrigerator 2 has a temperature of 20 K.

A second outlet of the helium compressor 1 is connected to a hot fluid inlet 31 of a first regenerator 3-1. A hot fluid outlet 32 of the first regenerator 3-1 is connected to a hot fluid inlet 38 of a second regenerator 3-2. A hot fluid outlet 35 of the second regenerator 3-2 is connected to an inlet of the cold head 5 of the cryogenic refrigerator 2. A third outlet of the helium compressor 1 is connected to a primary inlet 41 of an ejector 4. An outlet 43 of the ejector 4 has two ports. A first port of the outlet 43 of the ejector 4 is connected to the inlet of the cold head 5 of the cryogenic refrigerator 2. An outlet of the cold head 5 of the cryogenic refrigerator 2 is connected to an inlet of an end 6 to be cooled. An outlet of the end 6 to be cooled is connected to a cold fluid inlet 36 of the second regenerator 3-2. A cold fluid outlet 37 of the second regenerator 3-2 is connected to a secondary inlet 42 of the ejector 4. A second port of the outlet 43 of the ejector 4 is connected to a cold fluid inlet 33 of the first regenerator 3-1. A cold fluid outlet 34 of the first regenerator 3-1 is connected to an inlet of a pressure regulating valve 7. An outlet of the pressure regulating valve 7 is connected to the inlet of the helium compressor 1.

The working principles of the ejector-based cryogenic refrigeration system of this embodiment are described as follows. The helium is compressed in the helium compressor 1, and there are two helium cooling loops. In one loop, the high-pressure helium enters the cryogenic refrigerator 2, so that the cold head 5 of the cryogenic refrigerator has a temperature of 20 K. The low-pressure helium flows back to the helium compressor 1. In the other loop, a part of the high-pressure helium is precooled for the first time when passing through the first regenerator 3-1, and then enters the second regenerator 3-2 and is precooled for the second time, and then enters the cold head of the cryogenic refrigerator 2, and the other part of the high-pressure helium enters the ejector 4 as the primary flow. The high-pressure primary flow expands and accelerates in the nozzle of the ejector 4, and entrains the low-pressure secondary flow in the suction chamber of the ejector 4. The primary flow and the secondary flow enter a mixing section, and the momentum and energy thereof are exchanged to obtain a uniformly mixed flow. The uniformly mixed flow is compressed in the diffuser of the ejector 4, and then is divided into two branches. One branch passes the cold head 5 of the cryogenic refrigerator 2 to the end 6 to be cooled to absorb the heat of the end 6 to be cooled. Then, the flow passes the second regenerator 3-2 to be heated by the hot flow, and enters the ejector 4 as the secondary fluid. The other branch passes the first regenerator 3-1 to be heated, and finally flows back to the helium compressor 1. When the end 6 to be cooled requires a helium gas flow of 1.5 g/s, a temperature of 20 K and a cooling capacity of 75 W, the helium compressor 1 has a flow rate of 0.195 g/s, a power consumption of 674.4 W, and the system has an efficiency of 0.117. Compared to the conventional systems, the power consumption of the ejector-based cryogenic refrigeration system is reduced by 85.3%.

Figure 6:
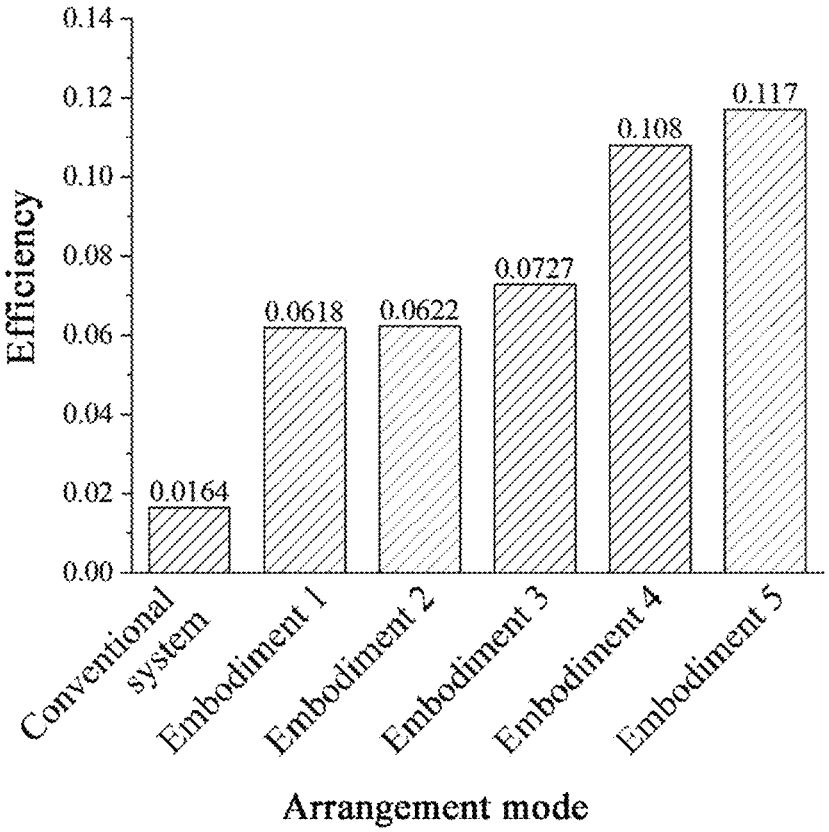
FIG. 6 is a diagram showing comparison on efficiencies of cryogenic refrigeration systems in accordance with at least one embodiment of the present disclosure and a conventional cryogenic refrigeration system.

FIG. 6 is a diagram showing comparison on efficiencies of the cryogenic refrigeration systems according to Embodiments 1-5 and the conventional cryogenic refrigeration system. In the conventional cryogenic refrigeration system, when the end 6 to be cooled requires a helium gas flow of 1.5 g/s, a temperature of 20 K and a cooling capacity of 75 W, the helium compressor 1 has a power consumption of 4583.33 W, and the system has an efficiency of 0.0164. Therefore, it can be concluded that efficiency of the cryogenic refrigeration system is greatly improved when the ejector is added.

The above embodiments are only illustrative of the present invention, and variations of structures, positions and connections of components of the present disclosure are possible. Any improvement and equivalent replacement without departing from the principle of the present disclosure shall fall within the scope of the present disclosure.

What is claimed is:

1. An ejector-based cryogenic refrigeration system for cold energy recovery, comprising a helium compressor;

wherein a first outlet of the helium compressor is connected to an inlet of a cryogenic refrigerator; an outlet of the cryogenic refrigerator is communicated with the inlet of the cryogenic refrigerator and is connected to an inlet of the helium compressor, so that a cold head of the cryogenic refrigerator has a temperature of 20 K;

a second outlet of the helium compressor is connected to a primary inlet of an ejector; an outlet of the ejector has two ports; a first port of an outlet of the ejector is connected to a hot fluid inlet of a regenerator; a hot fluid outlet of the regenerator is connected to an inlet of the cold head of the cryogenic refrigerator; an outlet of the cold head of the cryogenic refrigerator is connected to an inlet of an end to be cooled; an outlet of the end to be cooled is connected to a cold fluid inlet of the regenerator; a cold fluid outlet of the regenerator is connected to a secondary inlet of the ejector; a second port of the outlet of the ejector is connected to an inlet of a pressure regulating valve; and an outlet of the pressure regulating valve is connected to the inlet of the helium compressor.

* * * * *